United States Patent [19]

Olesen et al.

[11] Patent Number: 4,554,554

[45] Date of Patent: Nov. 19, 1985

[54] QUADRIFILAR HELIX ANTENNA TUNING USING PIN DIODES

[75] Inventors: Ralph C. Olesen, Waterford, Conn.; Robert A. Sainati, Bloomington, Minn.; John J. Gropelli, Jr., Pawcatuck; Andrew J. Stanland, Old Lyme, both of Conn.

[73] Assignee: The United States of America as represented by the Secretary of the Navy, Washington, D.C.

[21] Appl. No.: 528,825

[22] Filed: Sep. 2, 1983

[51] Int. Cl.[4] ..... H01Q 1/36

[52] U.S. Cl. ..... 343/895

[58] Field of Search ..... 343/895, 908, 845, 846

[56] References Cited

U.S. PATENT DOCUMENTS 3,949,407 4/1976 Jagdmann et al. ..... 343/895

*Primary Examiner*—Eli Lieberman

*Attorney, Agent, or Firm*—Robert F. Beers; Arthur A. McGill; Prithvi C. Lall

[57] ABSTRACT

An antenna is tuned in separate discrete frequency bands by changing the electrical length of the antenna. PIN diodes are placed at predetermined locations on the antenna coaxial cable radiating elements. When it is desired to shorten the antenna for a higher frequency band use, the diodes are biased short circuiting segments of the antenna. When the lower frequency band use is desired, diodes are unbiased so that the diodes act like a very small capacitance shunted by a large resistance which is essentially an open circuit permitting the entire length of the antenna to operate.

12 Claims, 7 Drawing Figures

QUADRIFILAR HELIX ANTENNA TUNING USING PIN DIODES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention generally relates to antennas and more particularly to an antenna system having a requirement of operating over two or more separate frequency bands.

2. Description of the Prior Art

A first option in achieving an antenna operable over two frequency bands is to make the antenna frequency response broadband to cover both desired bands of operation. Quite often this technique is difficult to achieve due to compromises that must be made in the antenna impedance match and gain to achieve the desired bandwidth. The second option is to use two antennas fed by a diplexer which is useful when the required bands of operation are widely separated. This option yields a much larger overall antenna structure. In addition the diplexer has an insertion loss that lowers the effective gain of each antenna in the structure. There is also a potential problem of coupling between the antennas causing degraded performance.

SUMMARY OF THE INVENTION

A PIN diode is a semiconductor device that operates as a variable resistor in the high frequency through microwave frequency bands. The diode has a very low resistance of less than one ohm when in a forward bias condition. The diode behaves as a small capacitance of approximately one picofarad shunted by a large resistance of approximately 10k ohms when under reverse bias. These characteristics make a PIN diode suitable as a switching device for altering the electrical length of coaxial cable radiating elements operating as a $\frac{1}{2}$ turn $\frac{1}{2}$ wavelength quadrifilar helix antenna. The forward biasing of PIN diodes short circuits segments of the antenna to effectively change the length of the coaxial cable radiating elements and thereby change the resonant frequency of the antenna so that the antenna has two separate resonant frequencies. A first resonant frequency when the PIN diodes are conducting and a second resonant frequency when the PIN diodes are not conducting. Multiple bands are available through a more complex arrangement of circuitry including forward and reverse biasing of PIN diodes from various locations.

DESCRIPTION OF THE PREFERRED EMBODIMENT

Figure 1:
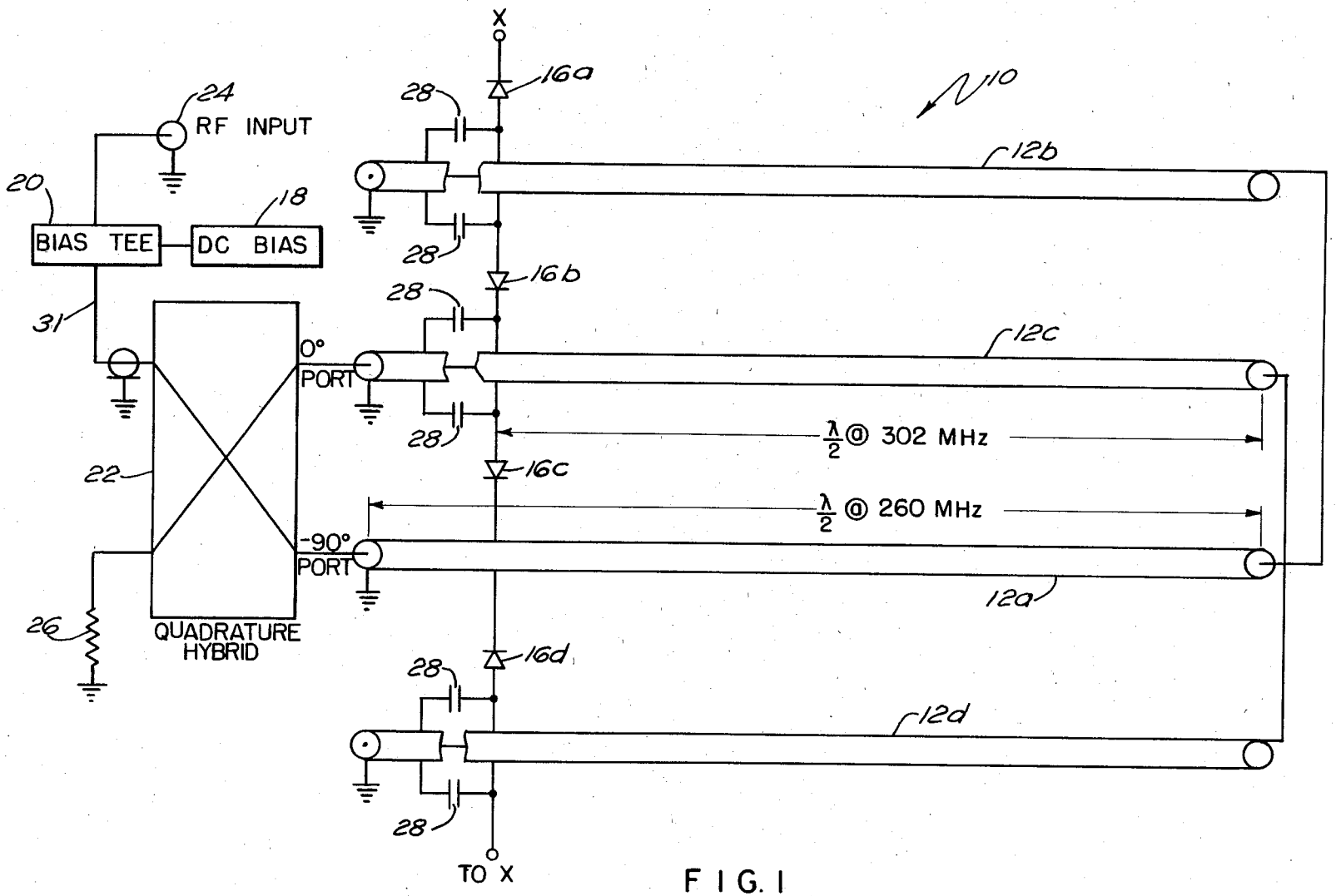
FIG. 1 is a schematic block diagram of an antenna system capable of operating over two frequency bands in accordance with the present invention.

Referring now to FIG. 1 there is shown a schematic-block diagram of the present invention using a $\frac{1}{2}$ turn $\frac{1}{2}$ wavelength quadrifilar helix antenna 10. The structure uses four grounded $\frac{1}{2}$ wavelength arms 12*a–d* that are fed in phase quadrature. Each pair of arms 12*a–b* and 12*c–d* in this type of structure has a narrow low VSWR bandwidth that is approximately 7% of the center frequency. The antenna 10 is tuned by varying the length of the arms 12*a–d*. The antenna 10 is able to operate in one of two UHF bands whose center frequencies are spaced 42 MHz. This necessitates changing the lengths of the arms 12 for the selected band center frequency. With the quadrifilar helix structure a circumferential belt was used to short the arms 12*a–b* together and ground them at the desired length establishing the lower frequency band with center frequency at 260 MHz. The higher frequency band with center frequency at 302 MHz is created when the PIN diodes 16*a–d* connected between the arms 12*a–d* are forward biased by a D.C. bias 18 applied at the −90° port input of one pair of arms 12*a–b*. This short-circuits the arms 12*a–d* together at a shorter length yielding the higher tuned frequency band.

In operation when the higher frequency band is desired the D.C. bias signal 18 is put into the bias TEE 20 which routes the bias signal 18 through the quadrature hybrid 22 to the −90°/−270° arm pair inputs 12*a* and 12*b*. At this time the r.f. input signal 24 is routed to both the −90°/−270° arm pair inputs 12*a* and 12*b* and the 0°/180° arm pair inputs 12*c* and 12*d*. Both r.f. input signal and D.C. bias signal are routed via r.f. feed cable 31. The quadrature hybrid 22 is balanced through a 50 ohm resistor 26. The bias current flows up the center conductor of the −90° arm 12*a* to the coaxial cable jacket of the −270° arm 12*b* and down the coaxial cable jacket. The bias current then splits to flow through each of the series diode pairs 16*a*, 16*d* and 16*b*, 16*c* to the grounded coaxial cable jacket of the −90° arm 12*a*. Coaxial cable outer conductors of arms 12*b*, 12*c* and 12*d* have a section removed and replaced by capacitors 28. The capacitors 28 shown are D.C. blocks that allow the r.f. currents to flow through the entire arms 12*b–d* when the diodes are not conducting during the reversed bias mode. This tunes the antenna 10 to the lower frequency.

Figure 2:
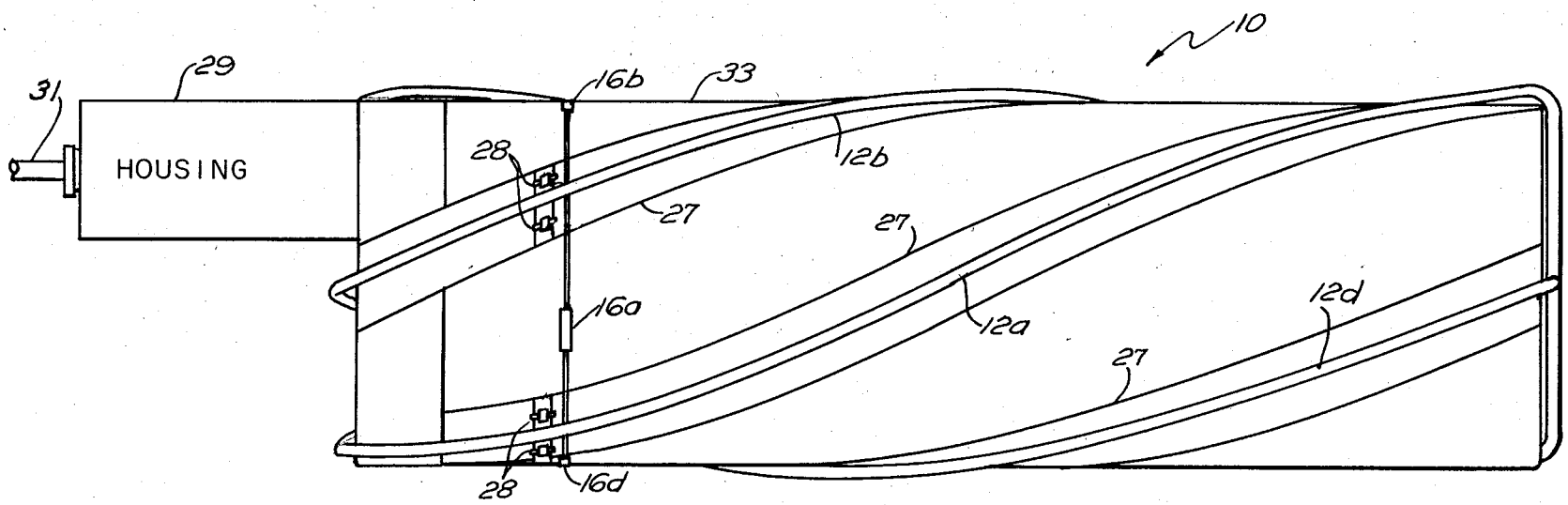
FIG. 2 is a pictorial representation of the diagram of FIG. 1.

A pictorial representation of the antenna 10 is shown in FIG. 2. The antenna 10 is constructed by wrapping a one inch wide copper tape 27 around a fiber glass cylinder 33 to which the coaxial cables 12*a*, 12*b*, 12*c* and 12*d* are attached (12*c* not shown). This copper tape 27 is used to give increased signal radiation to the helix arms 12*a–d*. The fiber glass cylinder 33 is 16" long and $4\frac{1}{2}$" in diameter. A housing 29 containing quadrature hybrid 22 (not shown) and 50 ohm resistor 26 (not shown) is connected at one end of cylinder 33. The bias TEE and bias circuit are connected via the r.f. feed cable 31 from a distant location.

Figure 3:
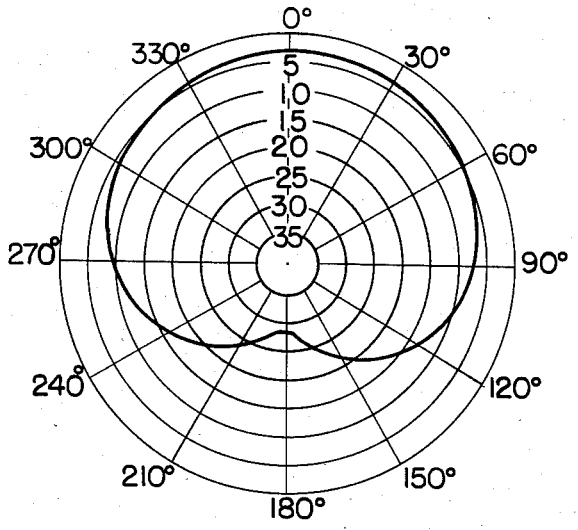
FIG. 3 is a measured antenna pattern at a first predetermined frequency.
Figure 4:
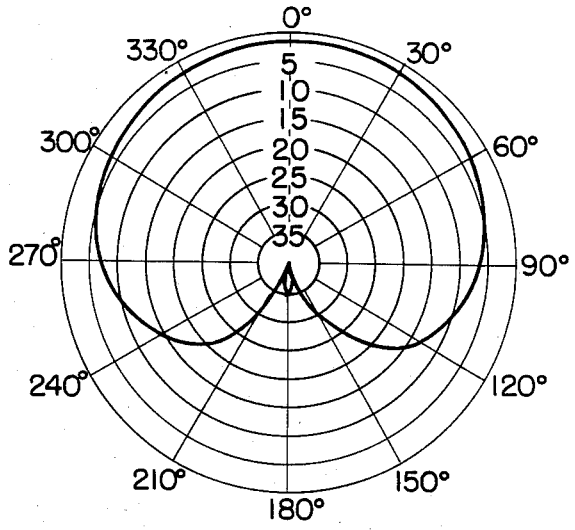
FIG. 4 is a measured antenna pattern at a second pre-determined frequency.

FIGS. 3 and 4 show the antenna patterns for 260 MHz and 300 MHz. From further testing it was observed that the antenna patterns for 250 MHz and 270 MHz were similar to the 260 MHz pattern and the 290 MHz and 310 MHz patterns were similar to the 300 MHz pattern.

Figure 5:
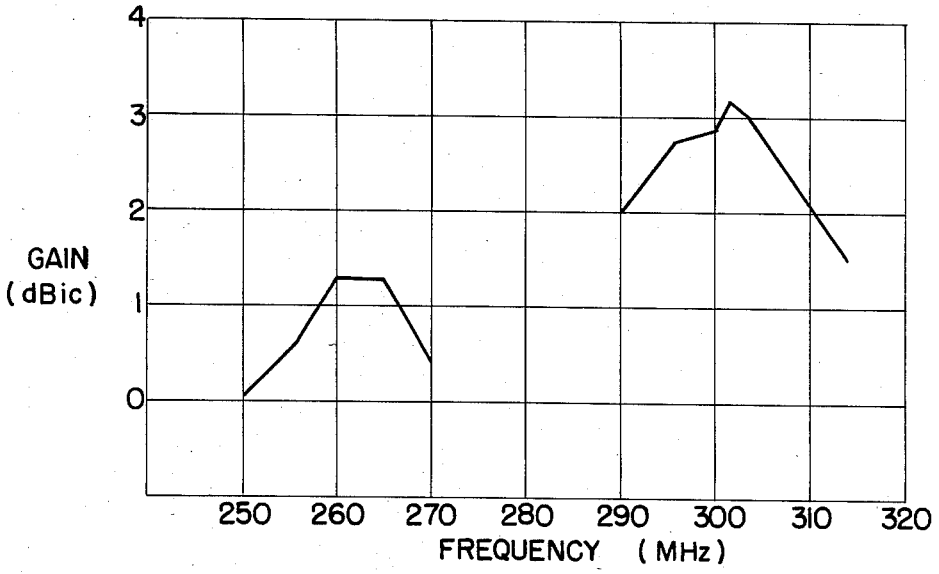
FIG. 5 is the measured antenna gain of the system of FIG. 1.

FIG. 5 shows the measured antenna gains (in dB referenced a circularly polarized isotropic source) over the two frequency bands. The difference in the gains between the bands is due to the antenna 10 being made physically smaller than optimum at the lower frequency due to imposed size constraints.

Figure 6:
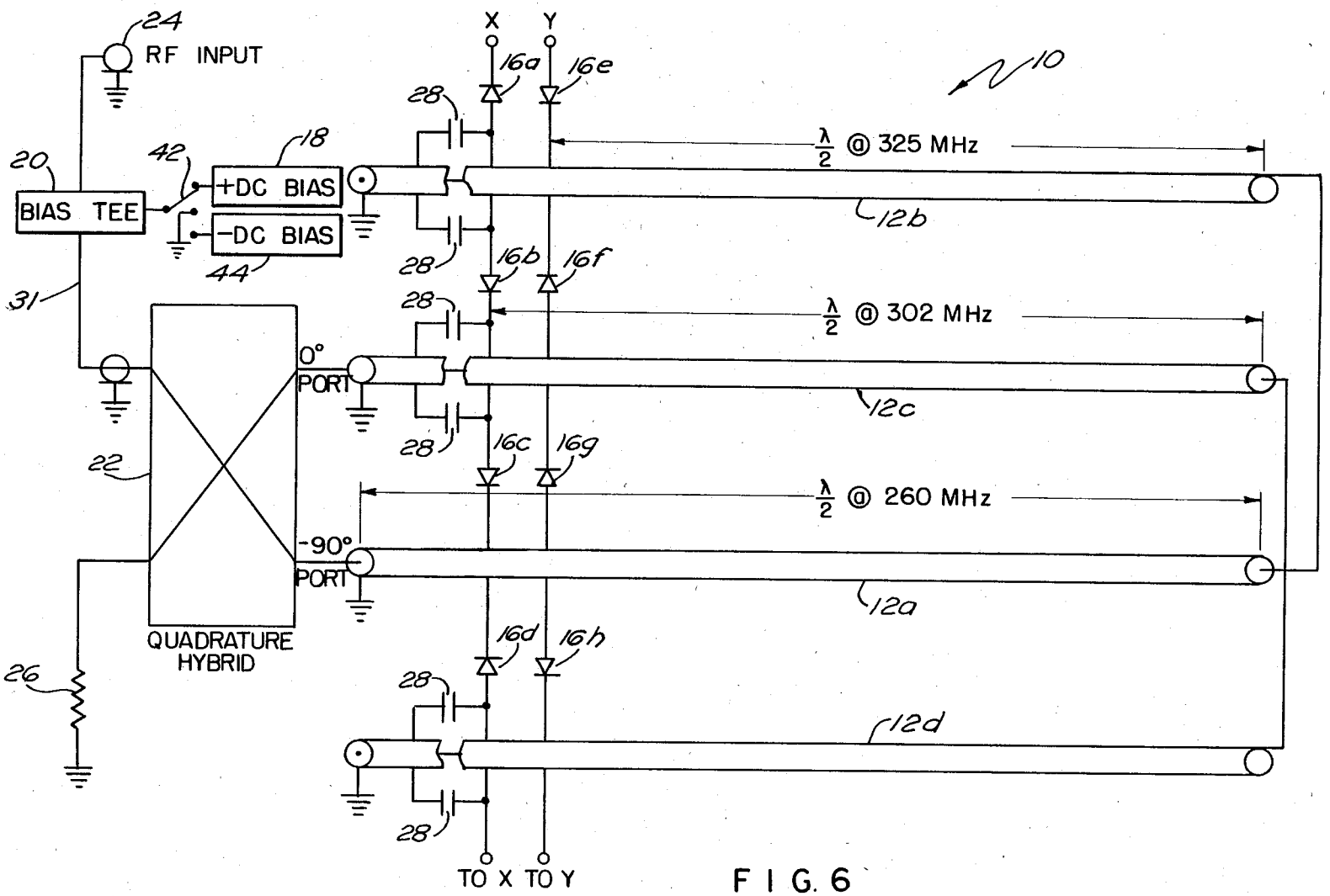
FIG. 6 is a schematic block diagram of an antenna system capable of operating over three frequency bands in accordance with the present invention.
Figure 7:
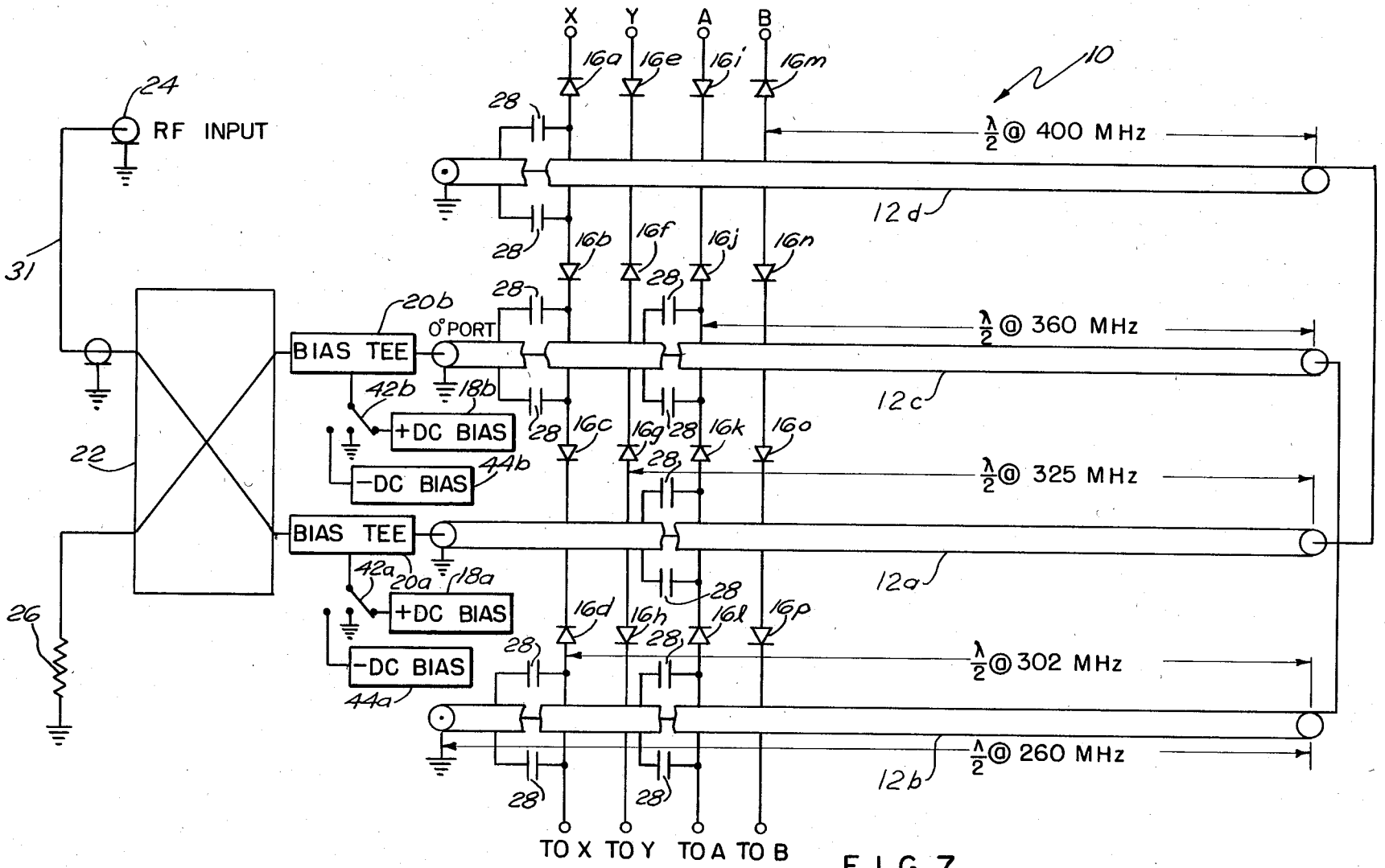
FIG. 7 is a schematic block diagram of an antenna system over multiple frequency bands in accordance with the present invention.

FIGS. 6 and 7 are extensions of the use of switching circuitry to show antenna systems capable of using more than the two frequency bands previously described. Similar numeral notation is used for the same components previously described.

Referring to FIG. 6 there is shown a schematic block diagram of a ½ turn ½ wavelength quadrifilar helix antenna 40 wherein a tuning in three separate frequency bands is obtainable. A typical selection switch 42 is introduced to select +DC bias 18, −DC bias 44 or zero bias. PIN diodes 16*e–h* are also added to the previously described system. The PIN diodes 16*e–h* are connected for negative voltage biasing and are located in a position that when they conduct the arms 12*a–d* are short circuited yielding a frequency band tuned at 325 MHz.

In operation when the switch 42 is on the grounded terminal the entire length of arms 12*a–d* operate giving a half-wave resonant frequency of 260 MHz. When the switch 42 is placed on the +DC Bias 18 PIN diodes 16*a–d* conduct creating a short circuit on arms 12*a–d* and yielding a half-wave resonant frequency of 302 MHz. The above two operations are similar to those described in FIG. 1. However, when the −DC bias 44 is connected to the remainder of the circuit by switch 42 a negative bias current flows through the center conductor of coaxial cable arms 12*a* along the outer conductor. of coaxial cable arms 12*b* and through the reversed biased PIN diode 16*e–h*. This creates a short circuit on the arms 12*a–d* at a new location. This location is obviously at the discretion of the designer. In the present case of half-wave resonant frequency of 325 MHz was selected.

FIG. 7 is a schematic block diagram of a ½ turn ½ wavelength quadrifilar helix antenna 60 wherein a tuning of two additional frequency bands over FIG. 6 or five in all is available. In FIG. 7 the bias TEES 20*a* and 20*b*, switches 44*a* and 44*b*, +DC bias 18*a* and 18*b*, and −DC bias 42*a* and 42*b* are similar to those in the previous figures. Additional segments are removed from coaxial cable outer conductors 12*a*, 12*c* and 12*d*. The segments are replaced by additional blocking capacitors 28. For tuning at 260 MHZ, 302 MHz and 325 MHz the system operates similar to that described for FIG. 6 with Bias TEE 20*a* and its associated components replacing Bias TEE 20 and its associated components. During this operation switch 42*b* is switched to the grounded terminal. For operation at 360 MHz switch 42*a* is placed on the grounded terminal and switch 42*b* supplies a DC bias through Bias TEE 20*b* through to the 0° port. The +DC bias signal is conducted through the center conductor of coaxial cable 12*c* onto the outer conductor of coaxial cable 12*d*. Then the cable arms 12*a–d* are short circuited through forward biased PIN diodes 16*l*, 16*k*, 16*j* and 16*i* onto the outer conductor of coaxial cable 12*b*. The +DC bias signal then travels along the outer conductor of coaxial cable 12*b* to the center conductor of cable 12*a* which is grounded via bias TEE 20*a* and switch 42*a*. If the 400 MHz resonant circuit is required then switch 42*a* is placed on the grounded terminal and the −DC bias signal is selected from switch 42*b*. This operation differs from the previous one for the 360 MHz resonant circuit in that the short circuiting is now done by the reversed direction PIN diodes 16*m–p*.

There has therefore been described a system that through a PIN diode tuning technique can be used to obtain greater available bandwidth from inherently narrowband antenna structures. The fast switching speed of the PIN diodes of less than 10 microseconds allows most systems to use a discrete band tuned antenna. The PIN diode tuning application eliminates the need for multiple discrete antennas when using the same antenna structure and for making performance degrading compromises when trying to broadband other antenna structures. The antenna designer is only limited by the required size of the antenna structure element or elements when extending this technique to a multiple band tuned antenna. The PIN diode technique can be used for both transmitting and receiving antennas because of the PIN diodes ability to pass high RF power levels.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. An antenna system comprising:

a resonant quadrifilar helix antenna having a plurality of arms with said arms grounded at a first predetermined location on each of said plurality of arms;

bias means for providing an electrical signal to said resonant antenna; and short circuit means connected to said resonant antenna at a second predetermined location on each of said plurality of arms, said short circuit means for receiving said electrical signal and for providing a short circuit to ground at said second predetermined location on each of said plurality of arms.

2. An antenna system according to claim 1 wherein said plurality of arms include a plurality of coaxial cables with all except one coaxial cable having a section of the outer conductor replaced by a capacitive impedance.

3. An antenna system according to claim 2 wherein said short circuit means further comprises connecting diodes from the outer conductor of one of said coaxial cables that has a section of the outer conductor replaced by a capacitive impedance through the other outer conductors of said coaxial cables that have a section of the outer conductor replaced by a capacitive impedance to the outer conductor of the coaxial cable that has its outer conductor intact.

4. An antenna system according to claim 3 further comprising:

said bias means is for providing a DC electrical signal to the inner conductor of said coaxial cable that has its outer conductor intact; and said inner conductor of said coaxial cable that has its outer conductor intact is connected to said outer conductor of said one of said coaxial cables that has a section of the outer conductor replaced by a capacitive impedance.

5. An antenna system comprising:

a resonant quadrifilar helix antenna having a plurality of arms with said arms grounded at a first predetermined location on each of said plurality of arms;

bias means for providing one of positive, negative and null DC electrical signal to said resonant antenna;

first short circuit means connected to said resonant antenna at a second predetermined location on each of said plurality of arms, said first short circuit means for receiving said electrical signal and for providing a short circuit to ground at said second predetermined location on each of said plurality of arms; and second short circuit means connected to said resonant antenna at a third predetermined location on each of said plurality of arms, said second short circuit means for receiving said electrical signal and for providing a short circuit to ground at said third predetermined location on each of said plurality of arms.

6. An antenna system according to claim 5 wherein said plurality of arms include a plurality of coaxial cables with all except one coaxial cable having a section of the outer conductor replaced by a capacitive impedance.

7. An antenna system according to claim 6 wherein said short circuit means further comprises connecting diodes from the outer conductor of one of said coaxial cables that has a section of the outer conductor replaced by a capacitive impedance through the other outer conductors of said coaxial cables that have a section of the outer conductor replaced by a capacitive impedance to the outer conductor of the coaxial cable that has its outer conductor intact.

8. An antenna system according to claim 7 further comprising:

said bias means is for providing one of positive, negative and null DC electrical signals to the inner conductor of said coaxial cable that has its outer conductor intact; and said inner conductor of said coaxial cable that has its outer conductor intact is connected to said outer conductor of said one of said coaxial cables that has a section of the outer conductor replaced by a capacitive impedance.

9. An antenna system comprising:

a resonant quadrifilar helix antenna having a plurality of arms with said arms grounded at a first predetermined location on each of said plurality of arms;

bias means for providing one of a first positive, negative and null DC electrical signal and for providing one of a second positive, negative and null DC electrical signal to said resonant antenna;

first short circuit means connected to said resonant antenna at a second predetermined location on each of said plurality of arms, said first short circuit means for receiving one of said first and one of said second electrical signals and for providing a short circuit to ground at said second predetermined location on each of said plurality of arms upon receipt of said first and second electrical signals;

second short circuit means connected to said resonant antenna at a third predetermined location on each of said plurality of arms, said second short circuit means for receiving one of said first and one of said second electrical signals and for providing a short circuit to ground at said third predetermined location on each of said plurality of arms upon receipt of said first and second electrical signals;

third short circuit means connected to said resonant antenna at a fourth predetermined location on each of said plurality of arms, said third short circuit means for receiving one of said first and one of said second electrical signals and for providing a short circuit to ground at said fourth predetermined location on each of said plurality of arms upon receipt of said first and second electrical signals; and fourth short circuit means connected to said resonant antenna at a fifth predetermined location on each of said plurality of arms, said fourth short circuit means for receiving one of said first and one of said second electrical signals and for providing a short circuit to ground at said fifth predetermined location on each of said plurality of arms upon receipt of said first and second electrical signals.

10. An antenna system according to claim 9 wherein said plurality of arms include a plurality of coaxial cables with each coaxial cable having at least one section of the outer conductor replaced by a capacitive impedance.

11. An antenna system according to claim 10 wherein said short circuit means further comprises a plurality of diodes connected between the outer conductor of one of said coaxial cables to an outer conductor of another coaxial cable through the other outer conductors of said coaxial cables.

12. An antenna system according to claim 11 further comprising:

said bias means is for providing one of said first positive, negative and null DC electrical signals to the inner conductor one of said coaxial cables and for providing one of said second positive, negative and null DC electrical signals to the inner conductor of another of said coaxial cables; and each of said inner conductors of said coaxial cables that have one of said first and second signals provided is connected to a respective outer conductor of a remaining coaxial cable.

* * * * *